US009863582B2

(12) United States Patent
Mertens et al.

(10) Patent No.: US 9,863,582 B2
(45) Date of Patent: Jan. 9, 2018

(54) GAS TANK CONTAINER

(71) Applicant: Van Hool NV, Lier (Koningshooikt) (BE)

(72) Inventors: Eddy Mertens, Lier (BE); Jan Van Haaren, Lier (BE)

(73) Assignee: VAN HOOL NV, Lier (Koningshooikt) (BE)

( * ) Notice: Subject to any disclaimer, the term of this patent is extended or adjusted under 35 U.S.C. 154(b) by 8 days.

(21) Appl. No.: 14/078,872

(22) Filed: Nov. 13, 2013

(65) Prior Publication Data

US 2014/0130914 A1 May 15, 2014

(30) Foreign Application Priority Data

Nov. 13, 2012 (BE) ..... 2012/0769

(51) Int. Cl.
*F17C 13/04* (2006.01)
*F17C 13/08* (2006.01)

(52) U.S. Cl.
CPC ..... *F17C 13/04* (2013.01); *F17C 13/083* (2013.01); *F17C 2201/0109* (2013.01); *F17C 2201/035* (2013.01); *F17C 2201/054* (2013.01); *F17C 2203/0617* (2013.01); *F17C 2205/0107* (2013.01); *F17C 2205/0126* (2013.01); *F17C 2205/0157* (2013.01); *F17C 2205/0188* (2013.01); *F17C 2205/0329* (2013.01); *F17C 2205/0367* (2013.01); *F17C 2205/0379* (2013.01); *F17C 2205/0385* (2013.01); *F17C 2205/0391* (2013.01); *F17C 2205/0394* (2013.01); *F17C 2223/0123* (2013.01); *F17C 2223/0153* (2013.01); *F17C 2223/033* (2013.01); *F17C 2223/035* (2013.01); *F17C 2223/047* (2013.01); *F17C 2225/047* (2013.01); *F17C 2250/043* (2013.01); *F17C 2250/0439* (2013.01); *F17C 2250/0491* (2013.01); *F17C 2260/01* (2013.01); *F17C 2260/036* (2013.01); *F17C 2265/063* (2013.01);

(Continued)

(58) Field of Classification Search
CPC . B65B 31/00; F17C 13/04; F17C 1/00; Y10T 137/86308; Y10T 137/8593
USPC ..... 137/561 R, 585; 220/1.5, 560.04, 562, 220/581
See application file for complete search history.

(56) References Cited

U.S. PATENT DOCUMENTS 1,469,646 A * 10/1923 Rowland ..... B65D 90/10 220/293
1,602,506 A * 10/1926 Rowland ..... F16L 41/10 137/454.2

(Continued)

FOREIGN PATENT DOCUMENTS

CA 2765684 A1 12/2010

*Primary Examiner* — Craig Schneider
*Assistant Examiner* — Nicole Gardner
(74) *Attorney, Agent, or Firm* — Knobbe Martens Olson & Bear LLP

(57) ABSTRACT

A gas tank container having increased volume is disclosed. The gas tank container for storing and/or transporting gas and/or liquid, includes a tank vessel, a frame and at least one outlet valve. The end of the outlet valve is attached to a tank flange, which is sunk in a recess at the end of the tank vessel. By recessing at least one outlet valve of the gas tank container, the length of the tank vessel can be optimized within the frame.

12 Claims, 2 Drawing Sheets

(52) U.S. Cl.
CPC ..... *F17C 2270/0105* (2013.01); *F17C 2270/0168* (2013.01); *Y10T 137/8593* (2015.04); *Y10T 137/86308* (2015.04)

(56) References Cited

U.S. PATENT DOCUMENTS

| | | | | | |
|---|---|---|---|---|---|
| 2,189,945 | A * | 2/1940 | Fitch | B60P 3/2205 | 220/562 |
| 2,271,660 | A * | 2/1942 | Norbom | B65D 88/128 | 220/1.5 |
| 2,609,964 | A * | 9/1952 | Cadwell | F17C 13/002 | 220/678 |
| 2,673,010 | A * | 3/1954 | Barrow | B65D 7/045 | 137/382 |
| 3,577,739 | A * | 5/1971 | Botkin | B60P 3/225 | 137/210 |
| 3,776,283 | A * | 12/1973 | Kramer | B60P 3/2255 | 141/45 |
| 4,320,788 | A * | 3/1982 | Lord | B67D 7/0478 | 137/255 |
| 4,932,551 | A * | 6/1990 | Thomas | B67D 7/0288 | 220/1.5 |
| 5,156,268 | A * | 10/1992 | Nichols | 206/386 | |
| 6,012,598 | A * | 1/2000 | Antoniou | B65D 88/128 | 220/1.5 |
| 7,322,227 | B2 | 1/2008 | Zhou et al. | | |
| 8,827,313 | B2 * | 9/2014 | Haut et al. | 280/839 | |
| 2005/0189357 | A1 * | 9/2005 | Moizumi | 220/562 | |
| 2007/0261756 | A1 | 11/2007 | Handa | | |
| 2008/0067178 | A1 | 3/2008 | Sun et al. | | |
| 2008/0087665 | A1 | 4/2008 | Rummel | | |
| 2013/0193150 | A1 * | 8/2013 | Keefer et al. | 220/562 | |

* cited by examiner

GAS TANK CONTAINER

RELATED APPLICATIONS

This application claims priority to BE2012/0769 filed Nov. 13, 2012, which is incorporated by reference in its entirety.

TECHNICAL FIELD

The present invention relates to increasing the volume of a gas tank container.

BACKGROUND

A gas tank container is an intermodal container for transporting liquids and/or gases. A standard gas tank container has a manhole and at least one connector. Loading and unloading takes place by connecting hoses from the loading and unloading installation to connectors of the gas tank container, following which loading or unloading can be effected. A connector is part of a valve, also referred to as an outlet valve, which can, if necessary, interrupt the supply or discharge of liquids and/or gases. In accordance with legal requirements, the connections are made by means of a composite valve.

Documents U.S. Pat. No. 7,322,227B2 and CA2765684A1 relate to examples of a prior art tank container.

The known intermodal gas tank containers suffer from the problem that the volume is limited by the dimensions of the frame around the container and by the space which the outlet valve takes up on the container and which has to stay inside (the casing of) the ISO frame.

A gas tank container is usually provided with a loading and unloading connection and a vapor-return connection. Tank connections have to satisfy the international requirements regarding the various transportation modes. This means that they have to contain a threefold serial safeguard: an inner valve which is protected against external damage, a second valve (e.g. ball valve) in line therewith and finally a seal, for example, in the form of a blind flange. This threefold protection is intended to prevent leaks and unintentional opening of connections. Depending on the infrastructure, gas tanks are operated either at the rear or at the side. In both cases, the available space is limited. The various suppliers offer compact threefold tank connections which satisfy the abovementioned requirements. Despite their compact construction, the length of these tank connections forms a limitation with regard to the tank volume which is possible within the ISO dimensions of the containers in the case of rear connections.

It is an object of the present invention to improve the design of a gas tank container to offer a solution to at least one of the aforementioned drawbacks when transporting gases, as described in claim 1.

SUMMARY OF THE INVENTION

The invention relates in particular to a gas tank container for storing and/or transporting gases and/or liquids, which gas tank container comprises a tank vessel, a frame and at least one outlet valve, wherein the end of said outlet valve is attached to a tank flange, which is preferably sunk between 1 to 30 cm in a recess of a tank end of said tank vessel, more preferably 5 to 20 cm, most preferably 10 to 15 cm, as described in claim 1.

In preferred embodiments, at least one outlet valve of the gas tank container includes a first valve and the first valve is situated inside a recess of the tank vessel. More preferably, at least one outlet valve of the gas tank container includes a first valve, a second valve and a seal and the first and second valve are situated within a recess of the tank vessel.

In preferred embodiments, at least one manhole is provided which is situated in the casing or in a tank end of the tank vessel.

In some preferred embodiments, the frame includes a front and rear frame which are attached to the ends of the gas tank container.

In some preferred embodiments, the gas tank container is approximately 20 feet (6,058 mm) long, 8 feet (2,438 mm) wide and 8 (2,438 mm) or 8.6 feet (2,591 mm) high. Preferably, the volume of the gas tank container is at least 24,000 l, more preferably at least 24,500 l and most preferably at least 25,000 l.

In some preferred embodiments, the gas tank container is approximately 30 feet (9,125 mm) long, 8 feet (2,438 mm) wide and 8 (2,438 mm) or 8.6 feet (2,591 mm) high. Preferably, the volume of the gas tank container is at least 38,000 l, more preferably at least 38,500 l and most preferably at least 39,000 l.

In some preferred embodiments, the gas tank container is approximately 40 feet (12,192 mm) long, 8 feet (2,438 mm) wide and 8 (2,438 mm) or 8.6 feet (2,591 mm) high. Preferably, the volume of the gas tank container is at least 51,500 l, more preferably at least 52,000 l and most preferably at least 52,500 l.

By recessing at least one outlet valve of a gas tank container, the length of the tank vessel can be optimized within the frame.

DESCRIPTION OF THE FIGURES

The figures below illustrate preferred embodiments of the invention.

DETAILED DESCRIPTION

Figure 1A:
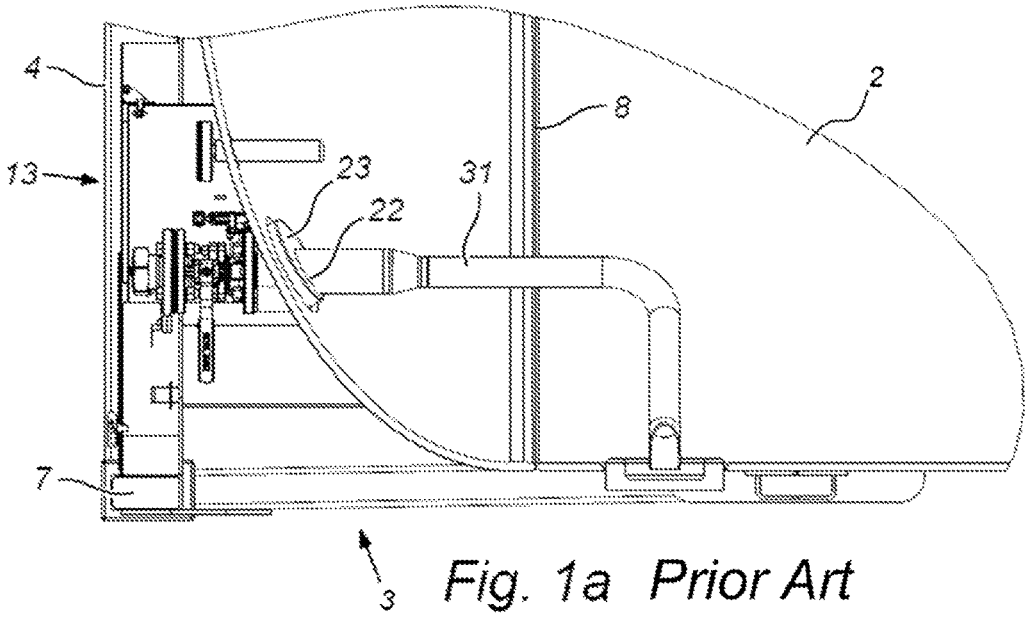
Fig. 1a Prior Art
FIG. 1*a* is a view in partial cross section of a gas tank container according to the prior art along the longitudinal axis of a gas tank container.

Below, the invention will be described with reference to non-limiting examples which illustrate the invention and which are not intended to and may not be interpreted as limiting the scope of the invention.

In a first aspect, the invention concerns a gas tank container for storing and/or transporting gases and/or liquids, which gas tank container comprises a tank vessel, a frame and at least one outlet valve, wherein the end of said outlet valve is attached to a tank flange, which is preferably sunk between 1 to 30 cm in a recess of a tank end of said tank vessel, more preferably 5 to 20 cm, most preferably 10 to 15 cm.

Usually, fitting outlet valves in the non-recessed variant is an obstacle which prevents the maximum vessel length from being achieved within the frame length. By recessing a flange in the tank vessel and attaching such an outlet valve, a portion of the outlet valve is sunk in a recess. Said recess results in a small loss of volume of the tank vessel, but makes it possible to optimize the length of the tank vessel inside the frame. The volume of the tank vessel consequently increases. This offers the advantage of an increased transport volume within the same frame dimensions.

In a preferred embodiment of the invention, at least one outlet valve of the gas tank container comprises a first valve and the first valve is situated within a recess of the tank vessel.

In a preferred embodiment of the invention, at least one outlet valve of the gas tank container comprises a first valve, a second valve and a seal and the first and second valves are situated inside a recess of the tank vessel.

In a preferred embodiment of the invention, the gas tank container is approximately 20 feet (6,058 mm) long, 8 feet (2,438 mm) wide and 8 (2,438 mm) or 8.6 feet (2,591 mm) high. In a more preferred embodiment, the volume of the gas tank container is preferably at least 24,000 l, more preferably at least 24,500 l and most preferably at least 25,000 l.

In a preferred embodiment of the invention, the gas tank container is approximately 30 feet (9,125 mm) long, 8 feet (2,438 mm) wide and 8 (2,438 mm) or 8.6 feet (2,591 mm) high. In a more preferred embodiment, the volume of the gas tank container is preferably at least 38,000 l, more preferably at least 38,500 l and most preferably at least 39,000 l.

In a preferred embodiment of the invention, the gas tank container is approximately 40 feet (12,192 mm) long, 8 feet (2,438 mm) wide and 8 (2,438 mm) or 8.6 feet (2,591 mm) high. In a more preferred embodiment, the volume of the gas tank container is preferably at least 51,500 l, more preferably at least 52,000 l and most preferably at least 52,500 l.

In a preferred embodiment of the invention, the gas tank container comprises a loading and unloading connection and a vapor-return connection.

In a preferred embodiment of the invention, at least one manhole is provided which is situated in the casing or in a bottom of the tank vessel.

In a preferred embodiment of the invention, the loading and unloading connection is connected to a supply duct which is situated inside the tank vessel and the end of which supply duct is directed toward the bottom of the tank vessel.

FIGURES

Prior Art:

FIG. 1*a* shows a partial cross-sectional view of a gas tank container (1) according to the prior art along the longitudinal axis of a gas tank container.

The gas tank container (1) is provided with a cylindrical tank vessel (2) and a frame (3) which comprises two lateral frames (4). These lateral frames (4) support the tank vessel (2). The tank vessel (2) is composed of different components which have been welded together, the weld seams (8) being illustrated in the figure.

The gas tank container (1) is provided with a vapor-return connection (20) and a loading and unloading connection (21), the latter being visible in the cross-sectional view. The loading and unloading connection (21) is attached to a flange (22) external to the tank vessel (2). The loading and unloading connection (21) is connected to a supply duct (31) which is situated inside the tank vessel (2).

Figure 1B:
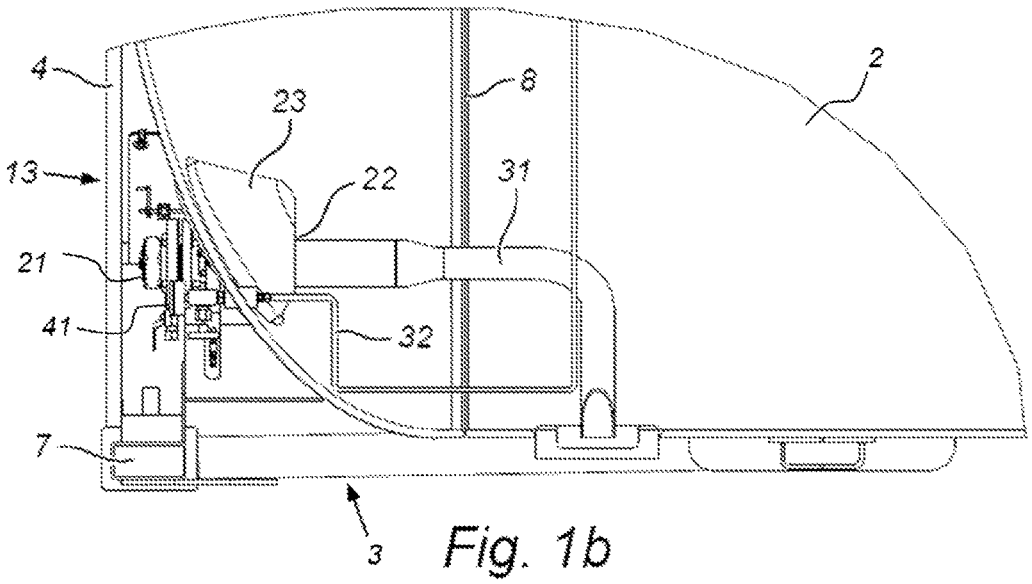
FIG. 1*b* is a partial cross-sectional view of a gas tank container along the longitudinal axis of a gas tank container, according to a preferred embodiment of the invention.

Invention:

FIG. 1*b* shows a partial cross-sectional view of a gas tank container along the longitudinal axis of a gas tank container, according to a preferred embodiment of the invention. This figure is a similar cross-sectional view as that of the prior art gas tank container in FIG. 1*a*.

In this figure, the loading and unloading connection (21) is attached to a flange (22) which is not external to the tank vessel (2), but internal to the tank vessel (2). The tank flange is therefore recessed in the vessel (2). As a result thereof, the length of the tank vessel within the frame (3) can be selected to be greater than is the case with a prior art gas tank container (see FIG. 1*a*). Despite the loss of volume due to the recess for, for example, the loading and unloading connection (21), the total volume of the tank vessel is increased.

The gas tank container (1) is also provided with a manometer (41) which is connected to the pipe (32) inside the tank vessel (2).

Figure 2:
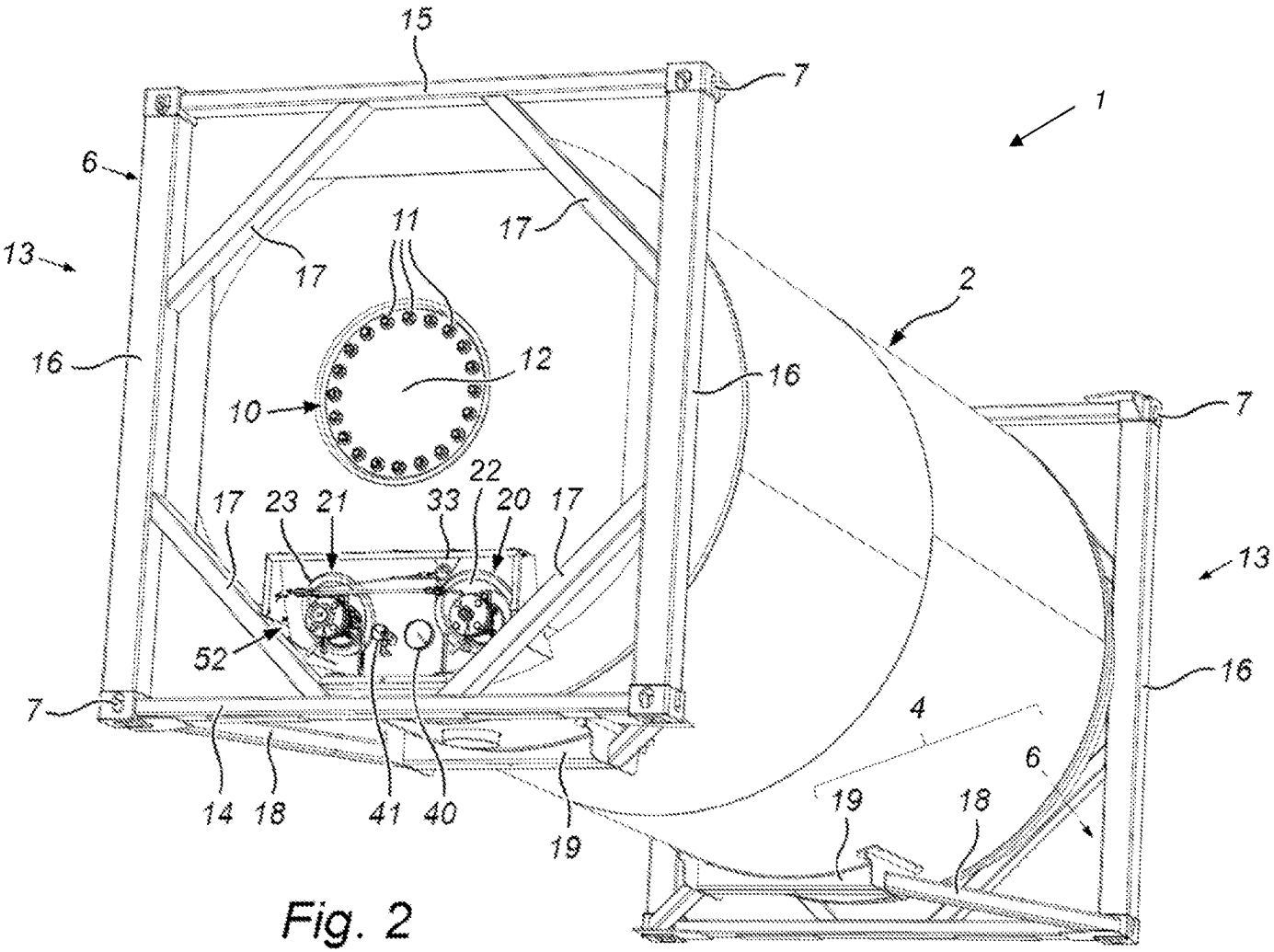
FIG. 2 shows a perspective view of a gas tank container according to a preferred embodiment of the invention.

FIG. 2 shows a perspective view of a gas tank container according to a preferred embodiment of the invention.

The front and rear frame (4) support the tank vessel (2) by means of two support saddles (19), each of which is connected to a head-end frame (6) on the two head ends (13) of the tank container (1) via support struts (18). The front frame or rear frame (4) comprises a support saddle (19), two support struts (18) and a head-end frame (6). Each head-end frame is provided with two upper and two lower corner pieces (7). The head-end frames (6) comprise upper and lower transverse beams (15, 14) and corner supports (16) which are fitted between the corner pieces (7). In addition, the head-end frames (6) are reinforced by means of diagonal struts (17) which are fitted therein.

This gas tank container (1) is provided with a manhole (10) in a tank end of the tank vessel (2). The manhole (10) is closed off by means of a manhole lid (12) using manhole bolts (11).

The gas tank container (1) is provided with a vapor-return connection (20) and a loading and unloading connection (21). The vapor-return connection (20) and the loading and unloading connection (21) are each attached to a flange (22) which is sunk into a recess (23) in the tank vessel (2). The loading and unloading connection (21) is connected to a supply duct (31) which is situated inside the tank vessel (2).

A combination handle (33) connects the vapor-return connection (20) and a loading and unloading connection (21). Thus, both outlet valves can be closed off and opened simultaneously.

Furthermore, in addition to the outlet valves, a thermometer (40) and a manometer (41) are provided in the rear cabinet (52) in order to display the temperature and the pressure inside the tank vessel (2), respectively. This rear cabinet (52) may be closed by means of a cover blind (9).

It is supposed that the present invention is not limited to the above-described embodiments and that some changes and modifications may be made to the examples described without re-evaluating the attached claims.

What is claimed is:

1. A gas tank container for storing and/or transporting gas, which gas tank container comprises:

a gas tank vessel comprising a pressurized gas, a frame, at least one outlet valve, and at least one vapor-return connection, wherein the end of said outlet valve and said vapor-return connection are attached to a gas tank flange, which is sunk between 1 to 30 cm in a recess of a curved tank end of said gas tank vessel, wherein said frame comprises a volume constraint with respect to said gas tank vessel, wherein a portion of said curved tank end surrounding said recess entirely circumferentially is extended toward said frame with respect to said tank flange for adding a volume surrounding said recess entirely circumferentially to a volume of said gas tank vessel, wherein said gas tank vessel comprises a supply duct for the supply or discharge of a gas, wherein said supply duct comprises a first end connected to said tank flange, and a second end being a free end located in the interior of the gas tank vessel, wherein the recess is located entirely and at least 10 cm above said second end of said supply duct and within the lower half of the gas tank vessel.

2. The gas tank container according to claim 1, wherein at least one outlet valve of the gas tank container comprises a first valve and wherein the first valve is situated inside a recess of the tank vessel.

3. The gas tank container according to claim 2, wherein at least one outlet valve of the gas tank container comprises a first valve, a second valve and a seal and wherein the first and second valve are situated within a recess of the tank vessel.

4. The gas tank container according to claim 1, wherein at least one manhole is provided which is situated in a casing or in a tank end of the tank vessel.

5. The gas tank container according to claim 1, wherein the frame comprises a front and rear frame which are attached to the ends of the gas tank container.

6. The gas tank container according to claim 1, wherein the gas tank container is approximately 20 feet (6,058 mm) long, 8 feet (2,438 mm) wide and 8 (2,438 mm) or 8.6 feet (2,591 mm) high.

7. The gas tank container according to claim 6, wherein the volume of the gas tank container is at least 24,000 l.

8. The gas tank container according to claim 1, wherein the gas tank container is approximately 30 feet (9,125 mm) long, 8 feet (2,438 mm) wide and 8 (2,438 mm) or 8.6 feet (2,591 mm) high.

9. The gas tank container according to claim 8, wherein the volume of the gas tank container is at least 38,000 l.

10. The gas tank container according to claim 1, wherein the gas tank container is approximately 40 feet (12,192 mm) long, 8 feet (2,438 mm) wide and 8 (2,438 mm) or 8.6 feet (2,591 mm) high.

11. The gas tank container according to claim 10, wherein the volume of the gas tank container is at least 51,500 l.

12. The gas tank container according to claim 1, wherein said second end is directed toward a sump provided in a bottom of said gas tank vessel, wherein said second end belongs to an essentially straight dip tube belonging to said supply duct, and wherein said second end comprises a dip tube bottom opening which is provided according to a non-orthogonal cross-section of said dip tube.

* * * * *